US005436817A

United States Patent [19]

Wotton et al.

[11] Patent Number: 5,436,817

[45] Date of Patent: Jul. 25, 1995

[54] RECESSED LAMP SOCKET SYSTEM FOR ILLUMINATED DECORATIVE FIGURES

[75] Inventors: Michael C. Wotton, Plantsville; Benson E. Zinbarg, Stamford, both of Conn.

[73] Assignee: Sun Hill Industries, Inc., Stamford, Conn.

[21] Appl. No.: 173,193

[22] Filed: Dec. 23, 1993

[51] Int. Cl.[6] ..... F21V 2/06; F21V 33/00

[52] U.S. Cl. ..... 362/267; 362/124; 362/806; 362/808; 362/363; 362/353; 40/540; 446/485

[58] Field of Search ..... 362/121, 124, 806, 808, 362/809, 226, 122, 807, 363, 351, 353, 151, 267; 446/485; 40/411, 540

[56] References Cited

U.S. PATENT DOCUMENTS

| | | | |
|---|---|---|---|
| 2,734,993 | 2/1956 | Fritz | 362/124 |
| 2,748,256 | 5/1956 | Moran | 362/124 |
| 3,220,130 | 11/1965 | Falkenberg | 362/808 X |
| 3,835,308 | 9/1974 | Reese | 362/124 X |
| 4,822,302 | 4/1989 | Dorleans | 362/226 X |
| 4,851,976 | 7/1989 | McMahan et al. | 362/226 |
| 5,183,329 | 2/1993 | Chen | 362/806 X |

*Primary Examiner*—Ira S. Lazarus
*Assistant Examiner*—Thomas M. Sember
*Attorney, Agent, or Firm*—David P. Gordon

[57] ABSTRACT

A lamp socket system for an illuminated decorative figure includes a lamp socket with an integral male electrical plug and a flange for mounting the socket in a hole in the decorative figure. The decorative figure is provided with a well surrounding a hole in which the socket is mounted. The well is large enough to accommodate the female end connector of an extension cord and may be provided with an oblong radially extending portion to accommodate an oblong female end connector. When the socket is installed in the hole in the figure and an extension cord is connected to the integral male plug on the socket, the electrical connection between the extension cord and the socket is sheltered by the well. The well protects the electrical connection from rain, snow, and other environmental elements. It also supports the weight of the female end connector of the extension cord so that the socket is not pulled out of the figure. Since the socket is installed at the interior end of the well, it does not protrude from the outer surface of the figure. The socket is thereby protected from damage during shipping and storage of the decorative figure. The decorative figures can be manufactured using conventional molding techniques to provide the well for receiving the socket. The socket can be insert molded with inserted conductive prongs, or can be assembled from several pieces. A fuse may be provided in the socket and the conductive prongs may be partially shrouded.

21 Claims, 8 Drawing Sheets

RECESSED LAMP SOCKET SYSTEM FOR ILLUMINATED DECORATIVE FIGURES

BACKGROUND OF THE INVENTION

1. Field of the Invention

The present invention generally relates to illuminated decorative figures. More particularly, the present invention relates to an illuminated decorative figure having a recessed lamp socket system which protects the socket and its electrical connection from damage and moisture.

2. State of the Art

Illuminated decorative figures are well known in the art. They typically simulate a holiday character or object such as a pumpkin, a ghost, a rabbit, Santa Claus, etc. and are often placed outdoors as a decoration to celebrate a holiday. Such figures are usually made of translucent blow molded plastic and fitted with a small lamp socket. The lamp socket is mounted through an opening in a wall of the molded plastic (usually the middle of a back wall) so that the lamp is located inside the figure. When the lamp is lit, the decorative figure is illuminated from within. It is known to choose the size and location of the lamp so that heat from the lamp does not melt the plastic figure.

Despite their long known popularity, illuminated decorative figures still have many disadvantages. The lamp socket typically protrudes from a wall (usually rear) of the figure where it is exposed to rain, snow, and physical damage during shipping and storage. The electrical cord connected to the lamp socket is usually too short to reach an electrical outlet; particularly when the figure is used outside. As a result, the electrical cord provided must be connected to an extension cord. The resulting connection to the extension cord either dangles from the lamp socket where the weight of the extension cord can pull the socket out of the figure, or it lies on the ground where it is exposed to snow, rain, and other environmental elements. In either case, the arrangement provides a significant electrical hazard.

SUMMARY OF THE INVENTION

It is therefore an object of the invention to provide a lamp socket system for an illuminated decorative figure which is protected from rain, snow, and other environmental elements.

It is also an object of the invention to provide a lamp socket system for an illuminated decorative figure which is protected from damage during shipping and storage.

It is another object of the invention to provide a lamp socket system for an illuminated decorative figure which connects to an extension cord in a secure safe manner and where the connection is protected from rain, snow, and other environmental elements.

It is still another object of the invention to provide a lamp socket system for an illuminated decorative figure which is less expensive to manufacture than the presently used lamp socket systems.

In accord with these objects which will be discussed in detail below, the lamp socket system for an illuminated decorative figure of the present invention includes a lamp socket with an integral male electrical plug and a flange for mounting the socket in a hole in the decorative figure. The decorative figure is provided with a cup-like recess surrounding a hole in which the socket is mounted. The cup-like recess is large enough to accommodate the female end connector of an extension cord. When the socket is installed in the hole in the figure and an extension cord is connected to the integral male plug on the socket, the electrical connection between the extension cord and the socket is sheltered by the cup-like recess. The cup-like recess protects the electrical connection from rain, snow, and other environmental elements. It also supports the weight of the female end connector of the extension cord so that the socket is not pulled out of the figure. Since the socket is installed at the interior end of the cup-like recess, it does not protrude from the outer surface of the figure. The socket is thereby protected from damage during shipping and storage of the decorative figure. By manufacturing the socket with an integral male electrical plug, it is less expensive than known socket systems which include a short electrical cord between the socket and the male electrical plug.

Preferred aspects of the invention include: providing the lamp socket with an integral fuse, providing the integral male electrical plug with a partial shroud, and forming the cup-like recess in the decorative figure with oblong extensions to accommodate the female end connector of a multiple outlet extension cord.

Those skilled in the art will appreciate that the combination of a cup-like recess in the figure and the integral male electrical plug on the socket results in the several synergistic advantages. The decorative figures can be manufactured using conventional molding techniques to provide the cup-like recess for receiving the socket. The socket can be insert molded with inserted conductive prongs, or can be assembled from several pieces.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
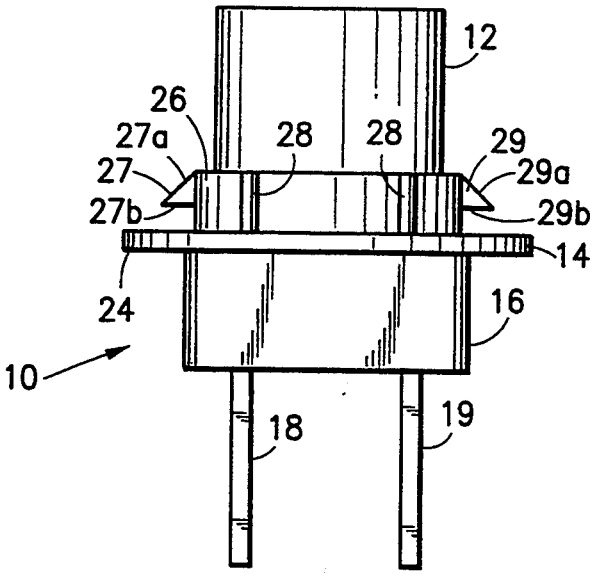
FIG. 1 is a side elevation view of a first embodiment of the socket of the invention.
Figure 1A:
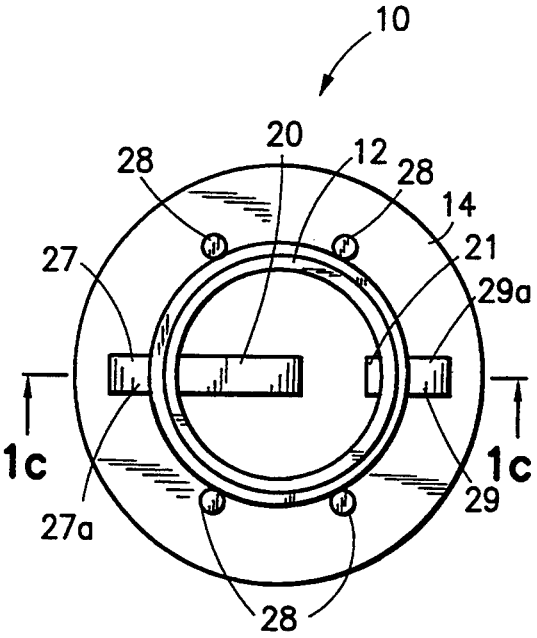
FIG. 1*a* is a top view of the socket of FIG. 1.
Figure 1B:
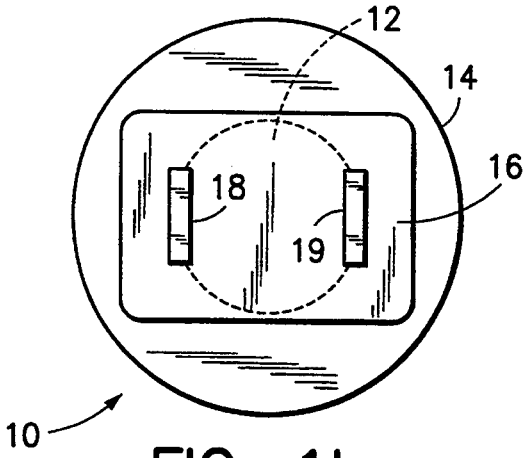
FIG. 1*b* is a bottom view of the socket of FIG. 1.
Figure 1C:
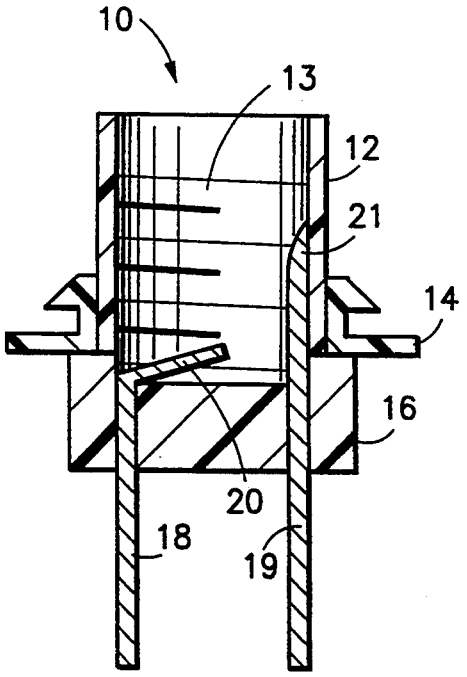
FIG. 1*c* is a cross section along line 1*c*—1*c* in FIG. 1*a;*

Referring now to FIGS. 1 through 1*c*, a first embodiment of the lamp socket 10 used in the system of the invention generally comprises a cylindrical lamp receiving portion 12, a mounting flange portion 14, and a plug holding portion 16 having a pair of male electrical connector blades or prongs 18, 19 extending therefrom. The lamp socket 10 is preferably manufactured by molding the cylindrical lamp receiving portion 12, the mounting flange portion 14, and the plug holding portion 16 as a single unit with the prongs 18, 19 and contacts 20, 21 inserted in the mold.

The lamp receiving cylindrical portion 12 of lamp socket 10 is provided with internal threads 13, a base contact 20, and a side contact 21. As seen best in FIGS. 1*a* and 1*c*, the base contact 20 is formed as a narrow bent extension of the connector blade or prong 18, and the side contact 21 is formed as a narrow curved extension of the connector blade or prong 19. Those skilled in the art will appreciate that when a conventional lamp such as the one shown in FIG. 2*f* is screwed into the lamp receiving portion 12 of socket 10, proper electrical contact is made to couple the filament of the lamp to the connector blades 18, 19.

The mounting flange portion 14 has a base 24 and a sleeve 26. Base 24 has a diameter larger than the diameter of the cylindrical lamp receiving portion 12. Sleeve 26 is provided with two or more ribs 28 and a pair of radially extending anchors 27, 29. Anchors 27, 29 have upper inclined faces 27*a*, 29*a* and lower parallel faces 27*b*, 29*b*. The lower faces 27*b*, 29*b* are parallel to and spaced apart from the base 24 as seen best in FIGS. 1 and 1*c*. As will be described in detail hereinafter, such an arrangement permits the mounting flange portion 14 to lockingly mount in the cup-like recess or well of the decorative figure of the invention.

Figure 1D:
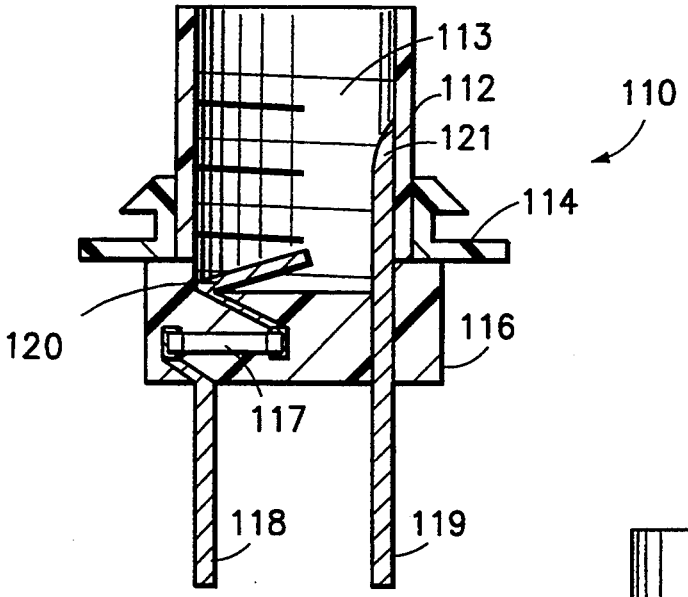
FIG. 1*d* is a view similar to FIG. 1*c* of an alternate first embodiment of the socket of the invention having an integral fuse.
Figure 1E:
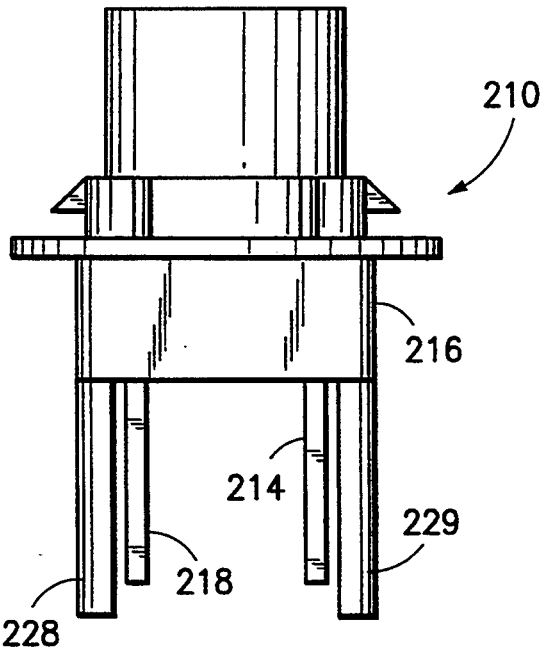
FIGS. 1*e* and 1*f* are views similar to FIGS. 1 and 1*b* of another alternate first embodiment of the socket of the invention having a partial shroud surrounding the plug.
Figure 1F:
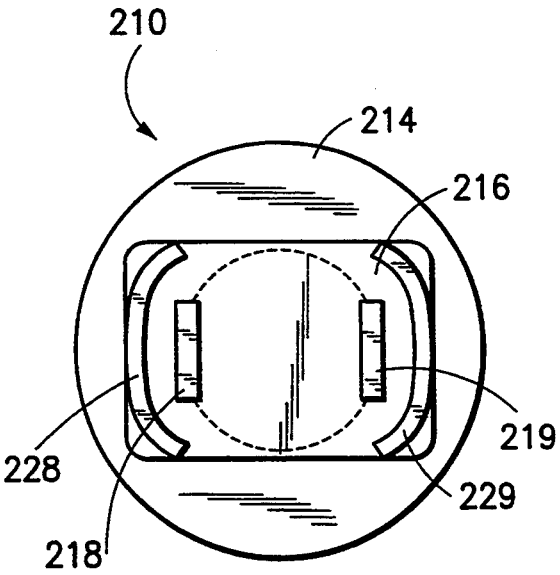

Alternate first embodiments of the first embodiment of the lamp socket are shown in FIGS. 1*d*, 1*e*, and 1*f*. FIG. 1*d*, for example, shows a lamp socket 110 which is substantially the same as the lamp socket 10 shown in FIG. 1*c* but with the addition of an internal fuse 117. As shown in FIG. 1*d*, the fuse 117 is coupled in series between the connector blade 118 and the base contact 120. Those skilled in the art will appreciate that the fuse 117 may be removable or fixed within the plug holding portion 116 of the socket 110. In the latter case, when the fuse blows, the entire lamp socket will be replaced. This may be less expensive than providing the lamp socket with means for accessing the fuse to replace it.

FIGS. 1*e* and 1*f* show side and bottom views of another alternate first embodiment of a lamp socket 210. This embodiment is substantially the same as the embodiment shown in FIGS. 1 and 1*b*, but with the addition of a non-conductive partial shroud 228, 229 flanking the connector blades 218, 219. The partial shroud is formed of two arcuate extensions 228, 229 which extend downward from the plug holding portion 216 and which may be formed as an integral part of the plug holding portion 216. The first arcuate extension 228 is spaced outward from connector blade 218 and the second arcuate extension 229 is spaced outward from connector blade 219. The arcuate extensions 228, 229 preferably extend further from the plug holding portion 216 than do the connector blades 218, 219 as shown best in FIG. 1*e*. The purpose of the arcuate extensions are to provide a safe finger gripping portions for the lamp socket when connecting the female end connector of an extension cord. Consequently, the space between the arcuate extensions is sufficiently wide to accommodate the female connector end of an extension cord such as shown in FIGS. 4*a* and 4*b* which are described in detail below. Those skilled in the art will appreciate that when connecting the female connector end of the extension cord to the plug portion of the lamp socket 10 in FIG. 1, there is the danger that fingers will slip onto the connector blades 18, 19 after initial electrical contact with the extension cord has been made. In order to prevent this, the partial shroud is provided in the form of the two arcuate extensions 228, 229 shown in FIGS. 1*e* and 1*f*.

Although the shroud is pictured in the drawings as a pair of relatively rigid arcuate members, those skilled in the art will appreciate that other configurations could be used. For example, the shroud could be formed as a cylindrical or rectangular flexible bellows member which collapses when the blades or prongs 18, 19 are inserted into the female end connector of an extension cord.

Figure 2:
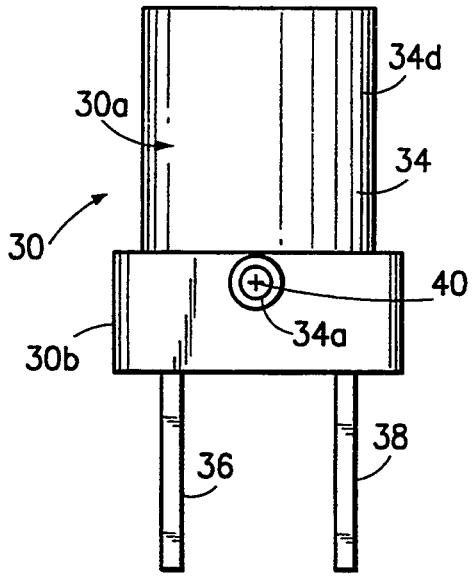
FIG. 2 is a view similar to FIG. 1, but of a first part of a second embodiment of the socket of the invention.
Figure 2A:
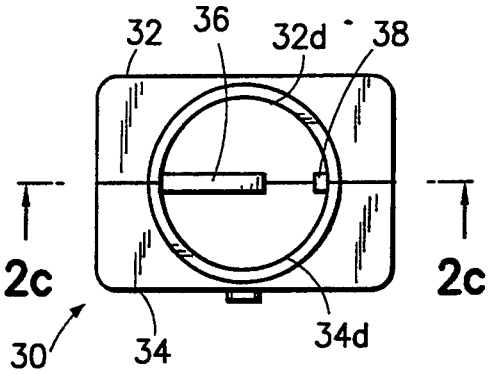
FIG. 2*a* is a top view of the socket of FIG. 2.
Figure 2B:
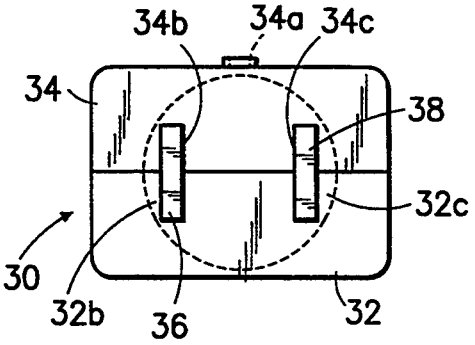
FIG. 2*b* is a bottom view of the socket of FIG. 2.
Figure 2C:
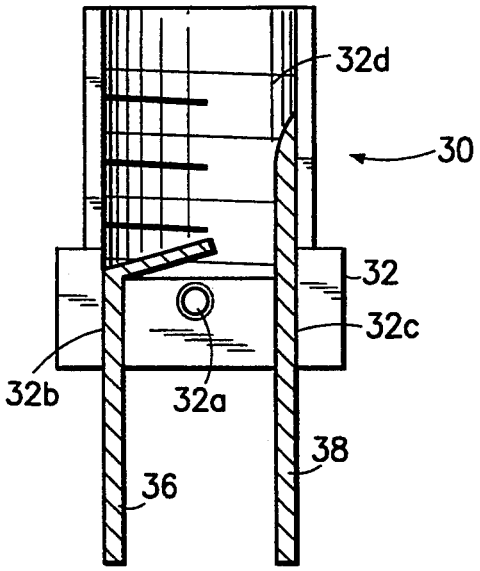
FIG. 2*c* is a cross section along line 2*c*—2*c* in FIG. 2*a;*
Figure 2D:
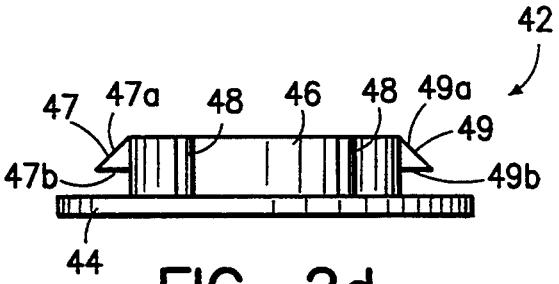
FIG. 2*d* is a side elevation view of a second part of the second embodiment of the socket of the invention.
Figure 2E:
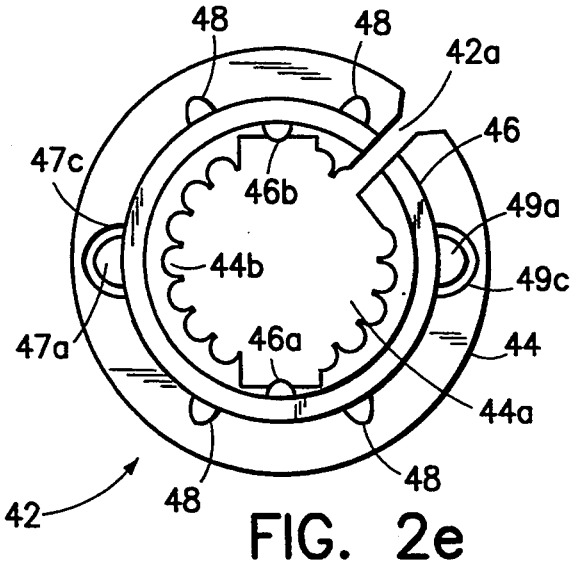
FIG. 2*e* is a top view of the second part of the second embodiment of the socket of the invention.
Figure 2F:
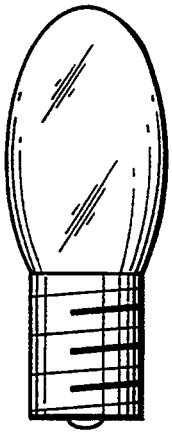
FIG. 2*f* is a side elevation view of a lamp.

FIGS. 2 through 2*e* show a second embodiment of lamp socket 30 which is assembled from six pieces: a first socket half 32; a second socket half 34; a first electrical contact 36; a second electrical contact 38; a screw 40; and a removable molded flange portion 42. The first socket half 32 is provided with a screw receiving threaded portion 32*a*, a first electrical contact receiving portion 32*b*, a second electrical contact receiving portion 32*c*, and an internally threaded semi-cylindrical portion 32*d*. The second socket half 34 is similarly provided with a screw receiving hole 34*a*, a first electrical contact receiving portion 34*b*, a second electrical contact receiving portion 34*c*, and an internally threaded semi-cylindrical portion 34*d*.

The first five parts (all but the flange 42) are assembled by placing the electrical contacts 36, 38 in the contact receiving portions 32*b*, 32*c* of the first socket half 32 (FIG. 2*c*), aligning the second socket half 34 with the first socket half (FIG. 2*b*) and connecting the socket halves with screw 40 (FIG. 2). The resulting assemblage is a socket having a cylindrical lamp receiving portion 30*a* and a plug holding portion 30*b*. Comparing FIGS. 1 and 2, it will be appreciated that socket 30 is substantially the same as the socket 10 described above, but without the flange portion.

A molded removable flange 42 (FIGS. 2*d* and 2*e*) is provided with a base 44 and a sleeve 46. Base 44 has a diameter larger than the diameter of cylindrical lamp receiving portion 30*a*. Sleeve 46 is provided with two or more outer ribs 48 and a pair of radially outward extending anchors 47, 49. Anchors 47, 49 have upper inclined faces 47*a*, 49*a* and lower parallel faces 47*b*, 49*b*. The lower faces 47*b*, 49*b* are parallel to and spaced apart from the base 44 as seen best in FIG. 2d. The upper faces 47*a*, 49*a* may be rounded or flat and the anchors can be molded as semihemispheres as shown in FIG. 2*e*. In order to facilitate molding, corresponding openings 47*c*, 49*c* may be provided in the base 44 below the anchors 47, 49. Sleeve 46 is also provided with a pair of radially inward extending protrusions 46*a*, 46*b* which can be formed as semi-hemispheres like the anchors described above.

As seen best in FIG. 2*e*, the base 44 of flange 42 is provided with a circular opening 44*a* having a scalloped inner edge 44*b*. Opening 44*a* is substantially coaxial with sleeve 46 and has an inner diameter slightly smaller than the diameter of the cylindrical lamp receiving portion 30*a* of the socket 30. Flange 42 is interrupted by a radial cut 42*a* through the base 44 and collar 46. Those skilled in the art will appreciate that the radial cut 42*a* provides diametrical resiliency allowing the diameter of the flange 42 to be adjusted through tension and compression.

The flange 42 is attached to the socket 30 by inserting the cylindrical lamp receiving portion 30*a* of socket 30 into the circular opening 44*a* as suggested by the relative placement of FIGS. 2*c* and 2*d*. The radial cut 42*a* allows the flange to be stretched slightly and the scalloped edge 44*b* of opening 44a provides a frictional engagement with the cylindrical lamp receiving portion 30*a* of socket 30. It will also be appreciated that the plug holding portion 30*b* of the socket 30 prevents the flange from sliding off the socket toward the plug blades 36, 38. It will also be appreciated that when an appropriately sized lamp such as the one shown in FIG. 2*f* is installed in the cylindrical lamp receiving portion 30*a*, the flange is prevented from sliding off the socket toward the lamp.

Figure 2G:
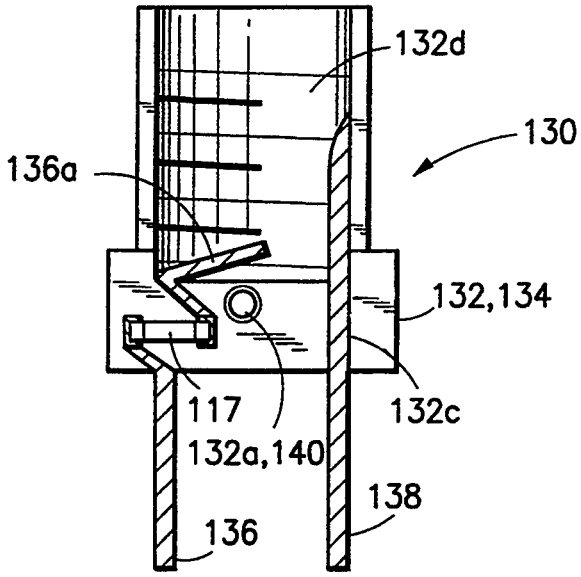
FIG. 2*g* is a view similar to FIG. 2*c* of an alternate second embodiment of the socket of the invention having an integral fuse.

FIG. 2*g* shows a first alternate of the second embodiment of a lamp socket 130. This embodiment is substantially the same as the embodiment shown in FIGS. 2 through 2*e*, but with the addition of an internal fuse 117. As seen in FIG. 2*g*, the fuse 117 is connected in series between connector blade 136 and the base contact 136*a* which extends into the base of the lamp receiving portion 132*d*. In this embodiment, as compared to the embodiment described above with reference to FIG. 1*d*, replacement of the fuse may be easily effected by removing a screw 140 from the threaded portion 132*a*, and separating the socket halves 132, 134 as described above with reference to FIGS. 2 through 2*e*.

Figure 2H:
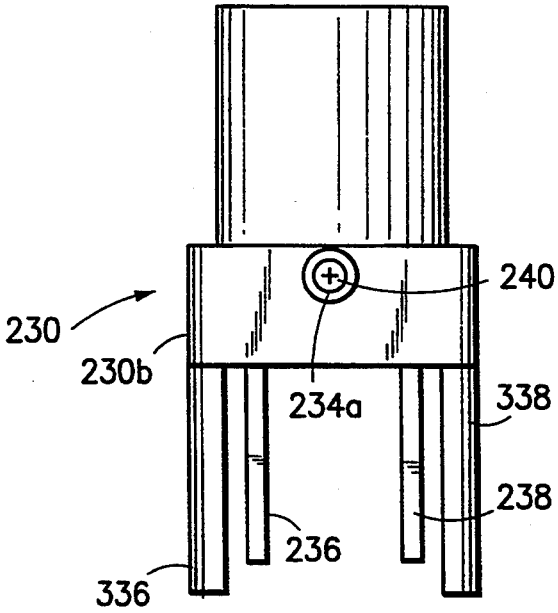
FIGS. 2*h* and 2*i* are views similar to FIGS. 2 and 2*b* of another alternate second embodiment of the socket of the invention having a partial shroud surrounding the plug.
Figure 2I:
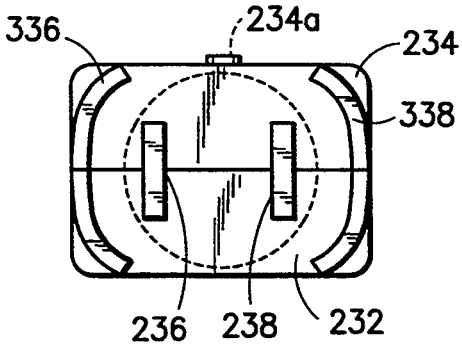

A second alternate of the second embodiment of a lamp socket 230 is shown in FIGS. 2*h* and 2*i*. This embodiment is substantially the same as the embodiment shown in FIGS. 2 through 2*e* but with the addition of partial shroud 336, 338 flanking connector blades 236, 238. The partial shroud in this embodiment is substantially the same as the partial shroud shown and described above with reference to FIGS. 1*e* and 1*f*. Those skilled in the art will appreciate that in this embodiment, the lamp socket is formed from two halves 232, 234 connected by screw 240. Therefore, the arcuate extensions 336, 338 forming the partial shroud will be segmented accordingly as seen best in FIG. 2*i*. Otherwise, the partial shroud serves the same purpose and operates in the same manner as the partial shroud described above with reference to FIGS. 1*e* and 1*f*.

Figure 3:
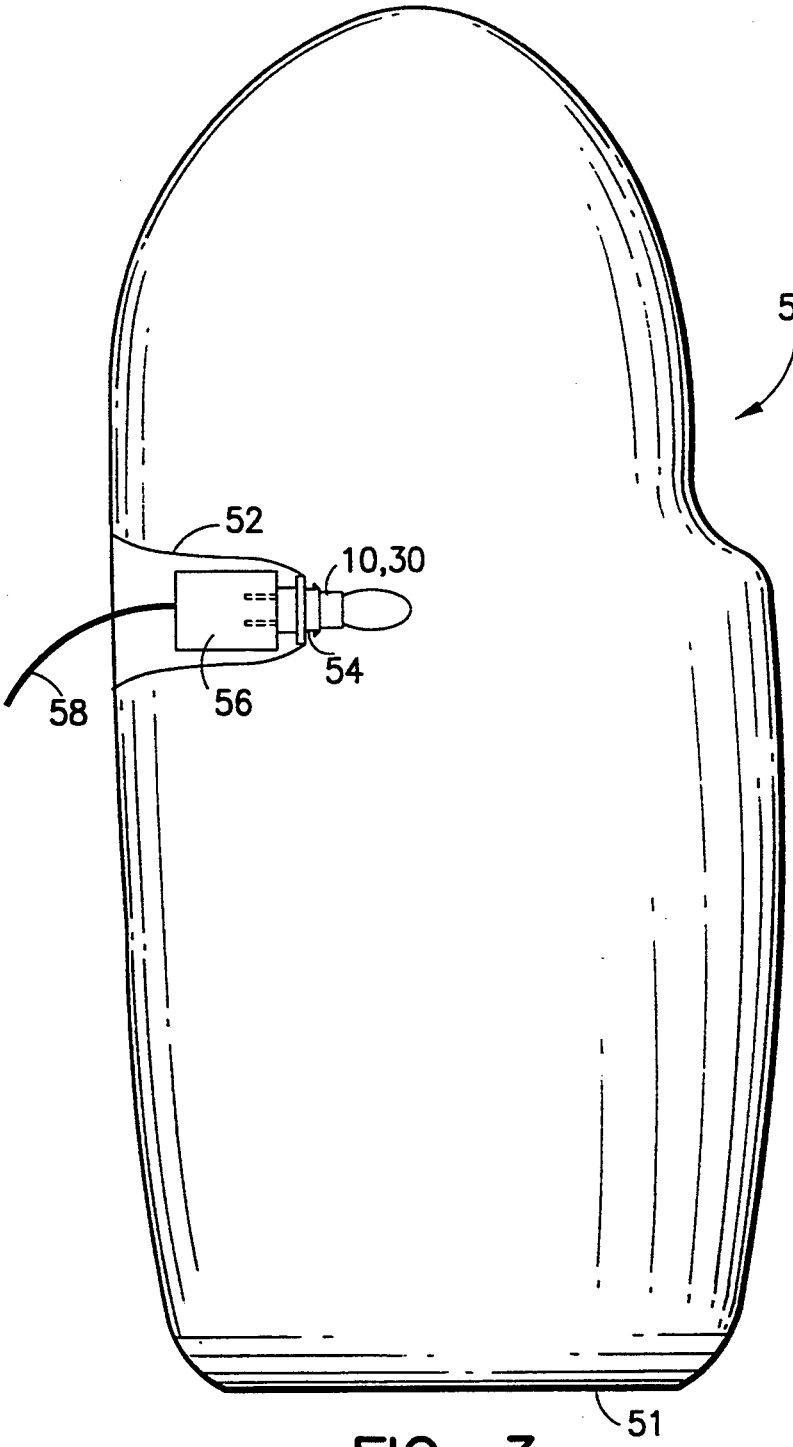
FIG. 3 is a transparent side view of a first embodiment of an illuminated decorative figure according to the invention.
Figure 3A:
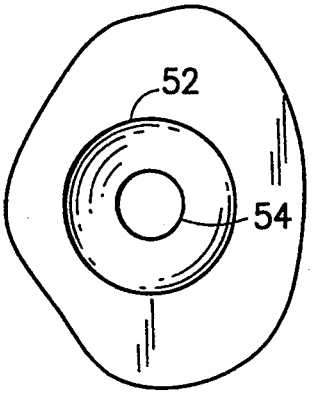
FIG. 3*a* is a rear view of the cup-like recess in the illuminated decorative figure of FIG. 3 without the socket and lamp installed.

FIGS. 3 and 3*a* show one embodiment of the cup-like recess or well 52 and socket receiving hole 54 in a blow molded decorative FIG. 50. The recess 52 and the receiving hole 54 are, in this embodiment, located in a rear wall of the molded FIG. 50 substantially above the base 51 of the FIG. 50. Socket 10 (30) is installed in the socket receiving hole 54 as described in detail below with reference to FIGS. 3*d* and 3*e*. The cup-like recess 52 is large enough to accommodate the female end 56 of an extension cord 58. As can be seen in FIG. 3, the cup-like recess 52 is also deep enough so that the entire female end 56 of the extension cord 58 is sheltered by the recess on five sides: front; two sides; top; and bottom. In other words, the connection is protected on all sides but the back.

Figure 3B:
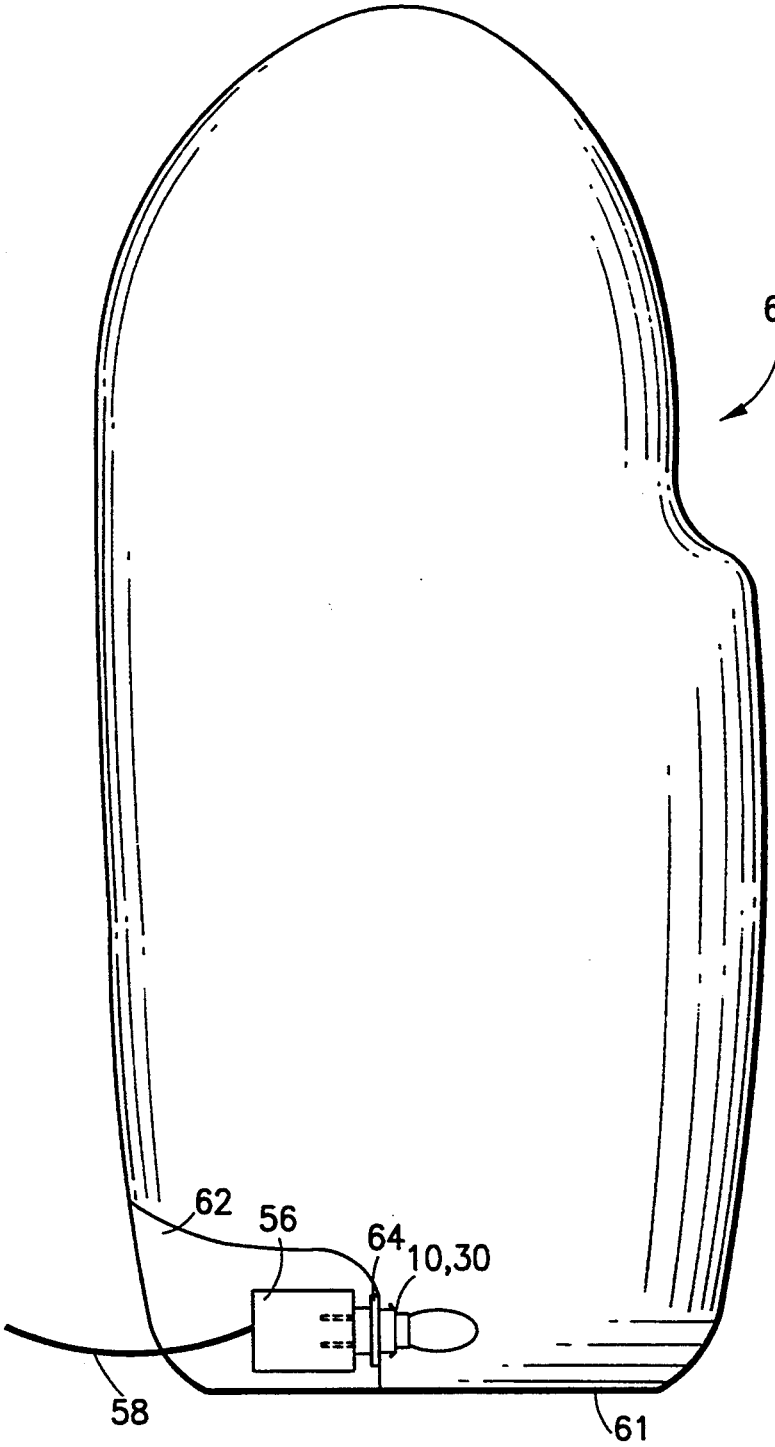
FIG. 3*b* is a transparent side view of a second embodiment of an illuminated decorative figure according to the invention.
Figure 3C:
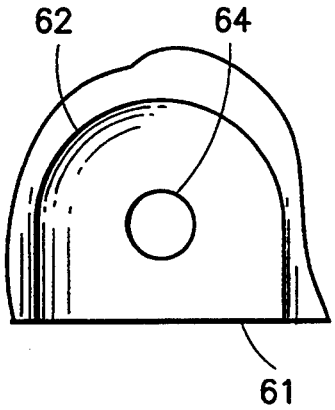
FIG. 3*c* is a rear view of the cup-like recess in the illuminated decorative figure of FIG. 3*b* without the socket and lamp installed.

FIGS. 3*b* and 3*c* show a second embodiment of the well 62 and socket receiving hole 64 in a molded decorative FIG. 60. Recess 62 and receiving hole 64 are, in this embodiment, located in a rear wall of the molded FIG. 60 adjacent the base 61 of the FIG. 60. The socket 10 (30) is installed in the socket receiving hole 64 as described in detail below with reference to FIGS. 3*d* and 3*e*. The cup-like recess 62 is large enough to accommodate the female end 56 of an extension cord 58. As can be seen in FIG. 3*b*, the cup-like recess 62 is also deep enough so that the entire female end 56 of the extension cord 58 is sheltered by the recess on four sides; front; two sides; and top. In other words, the connection is protected on all sides but the back and the bottom. It should be noted, however, that the bottom of the cup-like recess 62 is offered shelter by the surface on which the FIG. 60 is placed. While the embodiment of FIG. 3 is preferred, the embodiment of FIG. 3*b* still offers substantial advantages, particularly when it is otherwise desirable to place the lamp as close as possible to the base of the figure.

Figure 3D:
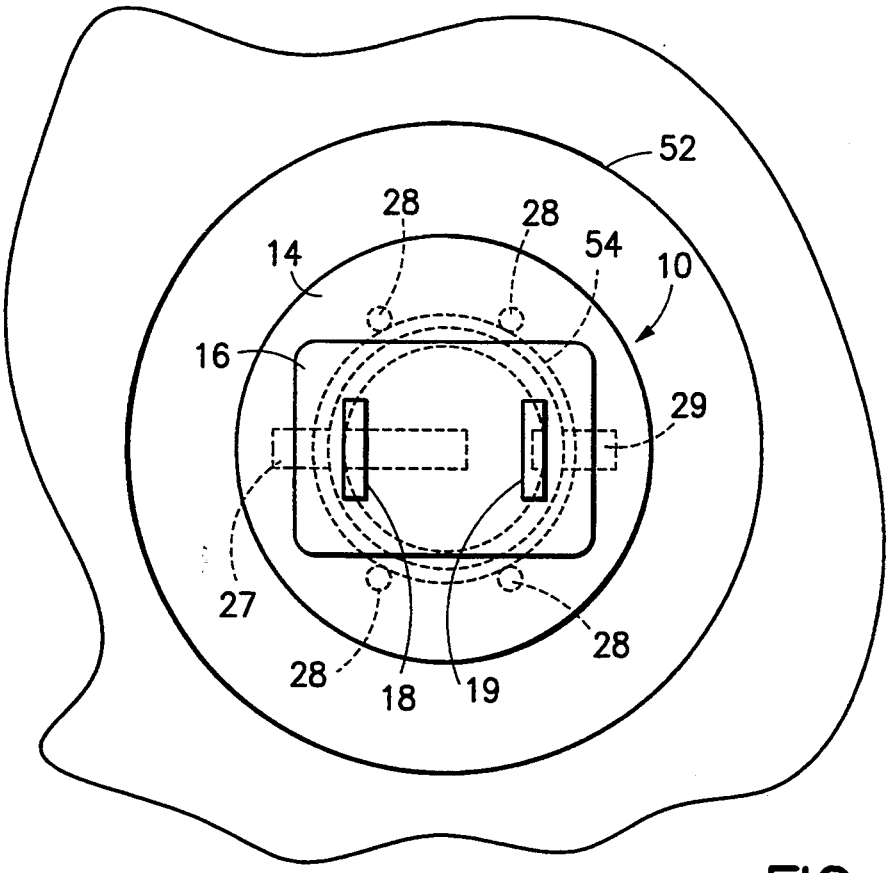
FIG. 3*d* is an enlarged rear view of the cup-like recess in the illuminated decorative figure of FIG. 3 with the socket of FIG. 1 installed.

With the above descriptions of the preferred sockets of the invention, and the preferred socket receiving hole of the invention, those skilled in the art will appreciate how the socket is installed in the hole. FIG. 3*d* shows a rear view of socket 10 installed in the socket receiving hole 54 at the interior end of the well 52 of the illuminated decorative FIG. 50 of FIG. 3. It will be seen that the base 24 of the flange portion 14 of the socket 10 remains outside the hole while the anchors 27, 29 of the flange portion 14 remain inside the hole. Since the molded FIG. 50 and the socket 10 are both plastic, some resilient deformation is possible while the socket 10 is pushed into the hole 54. In particular, the inclined surfaces 27*a*, 29*a* (FIG. 1) of the anchors 27, 29 urge resiliency between the hole 54 and the anchors 27, 29. Upon insertion of the socket into the hole, ribs 28 on the collar 26 of the flange 14 frictionally engage the inner edge of the hole 54 to minimize rotation of the socket in the hole. The lower faces 27*b*, 29*b* (FIG. 1) of the anchors 27, 29 prevent the socket from being removed from the hole absent substantial force being applied. In this regard, it will be appreciated that the distance between the lower faces 27*b*, 29*b* (FIG. 1) of the anchors 27, 29 and the upper surface of the base 24 should be sufficient to allow a snug fit with the wall of the decorative figure.

Figure 3E:
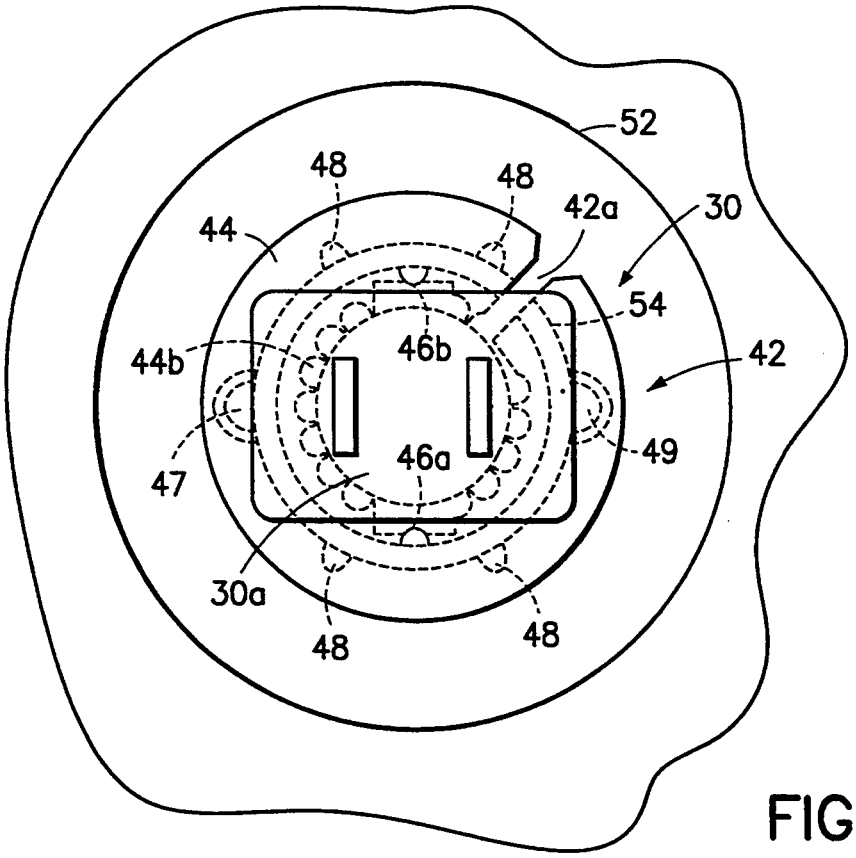
FIG. 3*e* is an enlarged rear view of the cup-like recess in the illuminated decorative figure of FIG. 3 with the socket of FIG. 2 installed.

FIG. 3*e* shows a rear view of the socket 30 and flange 42 installed in the socket receiving hole 54 of the illuminated decorative FIG. 50 of FIG. 3. It will be seen that the base 44 of the flange 42 remains outside the hole while the anchors 47, 49 remain inside the hole. In this embodiment, the flange 42 is made diametrically resilient with the aid of radial cut 42*a*. It will be appreciated that upon installation of the socket in the hole, the inner scalloped edge 44*b* of the opening 44*a* in the flange 42 frictionally engage the outer surface of the cylindrical portion 30*a* of the socket 30. In addition, the inward protrusions 46*a*, 46*b* of the sleeve 46 also engage the cylindrical portion 30*a*. Anchors 47, 49 and ribs 48 operate in substantially the same manner as described above with reference to FIG. 3*d*.

Figure 4:
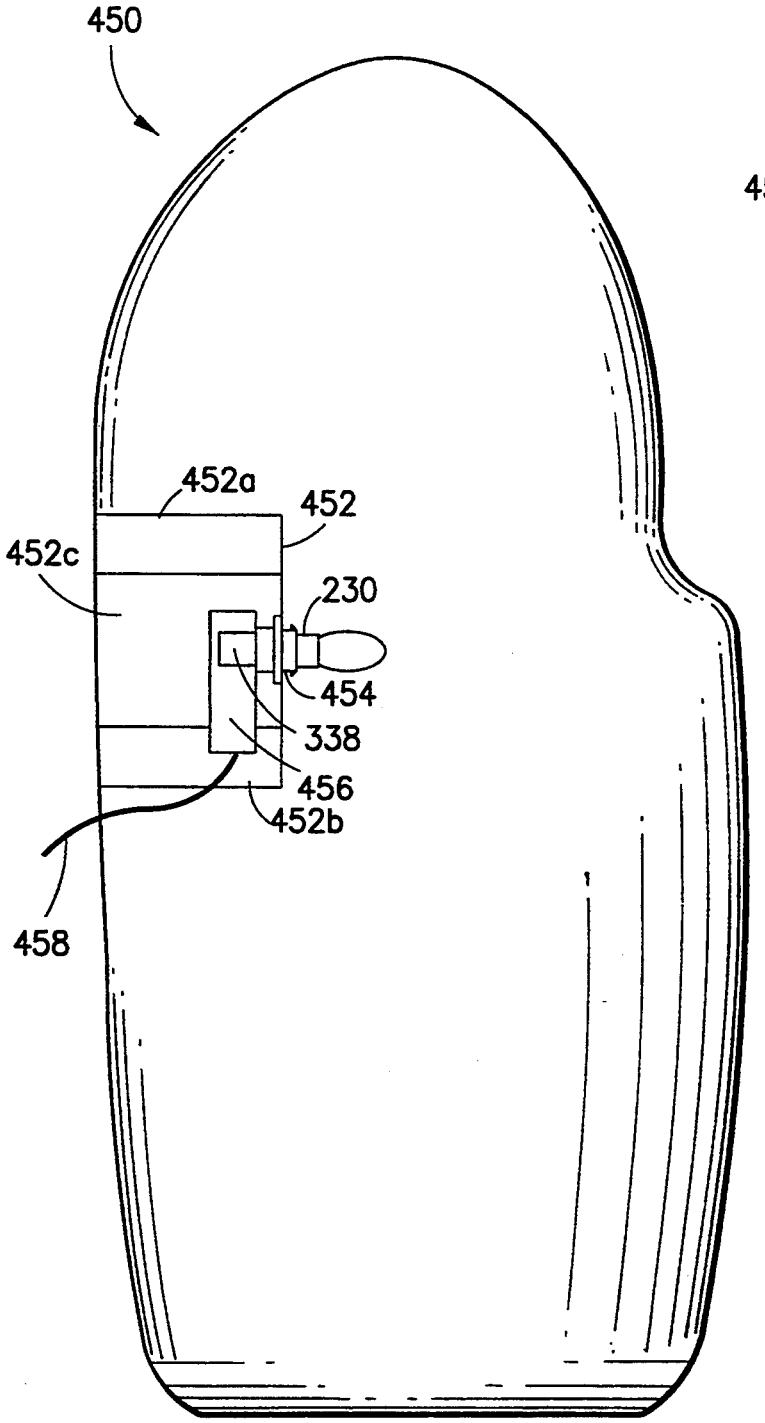
FIG. 4 is a view similar to FIG. 3 of a second embodiment of an illuminated decorative figure according to the invention.
Figure 4A:
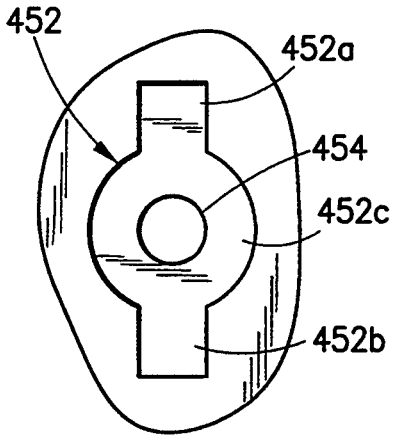
FIG. 4*a* is a view similar to FIG. 3*a* of the embodiment of FIG. 4.
Figure 4B:
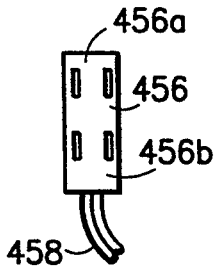
FIG. 4*b* is a broken side elevation view the female end connector of an extension cord accommodated by the recess shown in FIGS. 4 and 4*a*.

FIGS. 4 and 4*a* show an alternate embodiment of the cup-like 16 recess or well 452 in a blow molded decorative FIG. 450. The configuration of this recess 452 is particularly suited for use with a female end connector 456 of an extension cord 458 shown in FIGS. 4 and 4*b*. As those skilled in the art will appreciate, a typical extension cord 458 terminates in a female end connector 456 which is oblong and is provided with a pair of spaced apart sockets 456*a*, 456*b*. In order to properly accommodate an end connector of this shape, the recess or well 452 is provided with one or more oblong extensions 452*a*, 452*b* which extend radially outward from an inner circular recess 452*c*. As seen in FIG. 4, one of these oblong extensions 452*b* receives a portion of the oblong end connector 456 when the end connector is attached to the lamp socket 230. This arrangement provides the added advantage that the engagement of the end connector 456 within the oblong extension 452*b* prevents the lamp socket 230 from rotation within the receiving hole 454 further stabilizing the seating of the lamp socket in the receiving hole.

There have been described and illustrated herein several embodiments of a recessed lamp socket system for illuminated decorative figures. While particular embodiments of the invention have been described, it is not intended that the invention be limited thereto, as it is intended that the invention be as broad in scope as the art will allow and that the specification be read likewise. Thus, while particular flange and anchor arrangements have been disclosed, it will be appreciated that other arrangements could be utilized. Also, while specific constructions of a lamp socket with integral male electrical connector have been shown, it will be recognized that other types of lamp sockets with integral male connectors could be used with similar results obtained. While the lamp socket has been shown in one embodiment with an optional integral fuse and in another embodiment with an optional partial protective shroud, it will be understood that these features may be combined in other embodiments to provide all or some of the features disclosed. Moreover, while the decorative figure has been disclosed as being a blow molded plastic, it will be appreciated that the concepts of the invention could be applied to other types of decorative figures as well. Furthermore, while the cup- like recess has been shown in the figures as being substantially cylindrical and substantially cylindrical with oblong extensions, it will be understood that other configurations could be used with similar results obtained. It will therefore be appreciated by those skilled in the art that yet other modifications could be made to the provided invention without deviating from its spirit and scope as so claimed.

We claim:

1. A lamp socket system in an illuminated decorative figure adapted for direct coupling with the female end of an electrical extension cord, said lamp socket system comprising:

a) a well in said decorative figure, said well having a socket receiving hole at an interior end thereof; and b) a lamp socket having means for receiving a bulb, a male connector plug electrically coupled to said means for receiving a bulb, and mounting means for mounting said lamp socket in said socket receiving hole, such that when the female end of the extension cord is directly coupled to said male connector plug of said lamp socket, said well accommodates the female end of the extension cord and shields said male connector plug and at least a portion of the female end of the extension cord on at least four sides.

2. A lamp socket system according to claim 1, wherein:

said illuminated decorative figure has a back wall, said well is in a middle portion of said back wall, and said female end of the extension cord is shielded on at least five sides.

3. A lamp socket system according to claim 1, wherein:

said illuminated decorative figures has a back wall and a base, and said well is in a lower portion of said back wall adjacent said base of said illuminated decorative figure.

4. A lamp socket system according to claim 1, wherein:

said well is substantially cylindrical.

5. A lamp socket system according to claim 1, wherein:

said mounting means comprises a flange, a collar extending away from said flange, and at least one anchoring protrusion extending radially outward from said collar.

6. A lamp socket system according to claim 5, wherein:

said at least one anchoring protrusion comprises a pair of ramped protrusions spaced apart from said flange.

7. A lamp socket system according to claim 5, wherein:

said at least one anchoring protrusion comprises a pair of semi-hemispherical protrusions spaced apart from said flange.

8. A lamp socket system according to claim 5, wherein:

said at least one anchoring protrusion comprises at least one rib.

9. A lamp socket system according to claim 5, wherein:

said at least one anchoring protrusion comprises a pair of ramped protrusions spaced apart from said flange and a plurality of ribs extending longitudinally along said collar.

10. A lamp socket system according to claim 1, wherein:

said mounting means comprises a flange with a central hole, a collar extending away from said flange, and at least one anchoring protrusion extending radially outward from said collar, and said lamp socket includes a substantially cylindrical portion extending through said central hole in said flange.

11. A lamp socket system according to claim 10, wherein:

said central hole is provided with a scalloped inner edge for frictionally engaging said substantially cylindrical portion of said lamp socket.

12. A lamp socket system according to claim 10, wherein:

said collar is provided with at least one radially inward extending protrusion for frictionally engaging said substantially cylindrical portion of said lamp socket.

13. A lamp socket system according to claim 10, wherein:

said flange and said collar are provided with a radially cut out portion.

14. A lamp socket system according to claim 1, wherein:

said decorative figure and said well are blow molded translucent plastic.

15. An apparatus adapted to receive a lamp socket having male electrical prongs which are coupled to an electrical extension cord, comprising:

a blow molded translucent plastic figure having a back surface including a recess, said recess having a receiving hole at an interior end thereof adapted to receive the lamp socket, and said recess being sufficiently deep within said back surface so as to provide protective walls such that when the electrical extension cord is coupled to be male electrical prongs of the lamp socket, said walls shield the male electrical prongs and at least a portion of the electrical extension cord on at least three sides in addition to said receiving hole side.

16. An illuminated apparatus according to claim 15, wherein:

said recess is located along said back surface such that said protective walls shield the male electrical prongs on at least four sides in addition to said receiving hole side.

17. A lamp socket system according to claim 1, wherein: said lamp socket is provided with fuse means for fusibly breaking electrical coupling between said male connector plug and said means for receiving a bulb.

18. A lamp socket system according to claim 1, wherein: said lamp socket is provided with a partial shroud flanking said male connector plug.

19. A lamp socket system according to claim 4, wherein: said substantially cylindrical well is provided with at least one radially extending oblong portion.

20. An apparatus according to claim 15, wherein: said recess is substantially cylindrical with at least one radially extending oblong portion.

21. A lamp socket system according to claim 1, wherein:

said lamp socket extends at least partially into a substantially enclosed interior portion of said decorative figure.

* * * * *